US006377150B1

(12) United States Patent
Heinrich et al.

(10) Patent No.: US 6,377,150 B1
(45) Date of Patent: Apr. 23, 2002

(54) APPARATUS AND METHOD FOR FACILITATING HEAT DISSIPATION IN AN ELECTRICAL DEVICE

(76) Inventors: Randy Thomas Heinrich, 11350 Drummond, Dallas, TX (US) 75228; Robert Joseph Roessler, 935 W. Yellow Jacket La. # 1007, Rockwall, TX (US) 75087; David Leonard Stevens, 722 Sumner Dr., Mesquite, TX (US) 75149; Matthew Anthony Wilkowski, 2339 Heatherdale Dr., Mesquite, TX (US) 75150; William Lonzo Woods, 9453 County Rd. 133, Kaufman, TX (US) 75142

( * ) Notice: Subject to any disclaimer, the term of this patent is extended or adjusted under 35 U.S.C. 154(b) by 54 days.

(21) Appl. No.: 09/615,304

(22) Filed: Jul. 13, 2000

(51) Int. Cl.[7] ..... H01F 27/08; H01F 5/00

(52) U.S. Cl. ..... 336/55; 336/221; 336/200; 336/232

(58) Field of Search ..... 336/55, 65, 200, 336/223, 232, 221, 83

(56) References Cited

U.S. PATENT DOCUMENTS 5,565,837 A * 10/1996 Godek et al. ..... 336/232
5,764,494 A * 6/1998 Schutten et al. ..... 363/17
6,252,487 B1 * 6/2001 Wolf et al. ..... 336/221

* cited by examiner

*Primary Examiner*—Anh Mai
(74) *Attorney, Agent, or Firm*—Law Office of Donald D. Mondul

(57) ABSTRACT

An apparatus is disclosed for facilitating heat dissipation in an electrical device hat includes a core structure traversing a substrate when the core structure is in an installed orientation. The apparatus comprises: (a) at least one aperture through the substrate for accommodating traversing by the core structure; each respective aperture has periphery defined by a respective circumjacent face extending a height substantially equal with the substrate thickness; (b) a layer of thermally conductive material situated discontinuously on the circumjacent face of at least one respective aperture. The respective aperture is configured to establish a thermally conductive engagement with at least one facing portion of the core structure traversing the respective aperture in the installed orientation. The method comprises the steps of: (a) providing at least one aperture through the substrate for accommodating the traversing by the core structure; each respective aperture having a circumjacent face extending a height substantially equal with the substrate thickness; (b) providing a layer of thermally conductive material situated discontinuously on the circumjacent face of at least one respective aperture; and (c) assembling the electrical device in the installed orientation. The respective aperture is configured to establish a thermally conductive engagement with at least one facing portion of the core structure traversing the aperture in the installed orientation.

20 Claims, 3 Drawing Sheets

APPARATUS AND METHOD FOR FACILITATING HEAT DISSIPATION IN AN ELECTRICAL DEVICE

BACKGROUND OF THE INVENTION

The present invention is directed to dissipation of heat from electrical devices that include ferrous core elements that traverse a substrate when the electrical device is in an assembled, or installed orientation. Dissipation of heat from assembled electrical devices is a significant concern for a product designer, and the problem of heat dissipation is exacerbated as the power utilized by the electrical device increases. Heat dissipation is a particularly challenging problem in today's high-power power supply products.

SUMMARY OF THE INVENTION

An apparatus is disclosed for facilitating heat dissipation in an electrical device that includes a core structure traversing a substrate when the core structure is in an installed orientation. The substrate has a thickness. The apparatus comprises: (a) at least one aperture through the substrate for accommodating traversing by the core structure; each respective aperture has a periphery defined by a respective circumjacent face extending a height substantially equal with the thickness; (b) a layer of thermally conductive material situated in a discontinuous arrangement on the circumjacent face of at least one respective aperture. The respective aperture is configured to establish a thermally conductive engagement with at least one facing portion of the core structure traversing the respective aperture in the installed orientation. The discontinuous arrangement may present one discontinuity in the thermally conductive material, or may present a plurality of discontinuities in the thermally conductive material. A layer of a thermally conductive material may also be situated in a discontinuous arrangement on at least one respective facing portion of the at least one facing portion of the core structure.

The method comprises the steps of: (a) providing at least one aperture through the substrate for accommodating the traversing by the core structure; each respective aperture having a periphery defined by a respective circumjacent face extending a height substantially equal with the thickness; (b) providing a layer of thermally conductive material situated in a discontinuous arrangement on the circumjacent face of at least one respective aperture; and (c) assembling the electrical device in the installed orientation. The respective aperture is configured to establish a thermally conductive engagement with at least one facing portion of the core structure traversing the aperture in the installed orientation.

Further objects and features of the present invention will be apparent from the following specification and claims when considered in connection with the accompanying drawings, in which like elements are labeled using like reference numerals in the various figures, illustrating the preferred embodiments of the invention.

DETAILED DESCRIPTION OF THE PREFERRED EMBODIMENT

Figure 1:
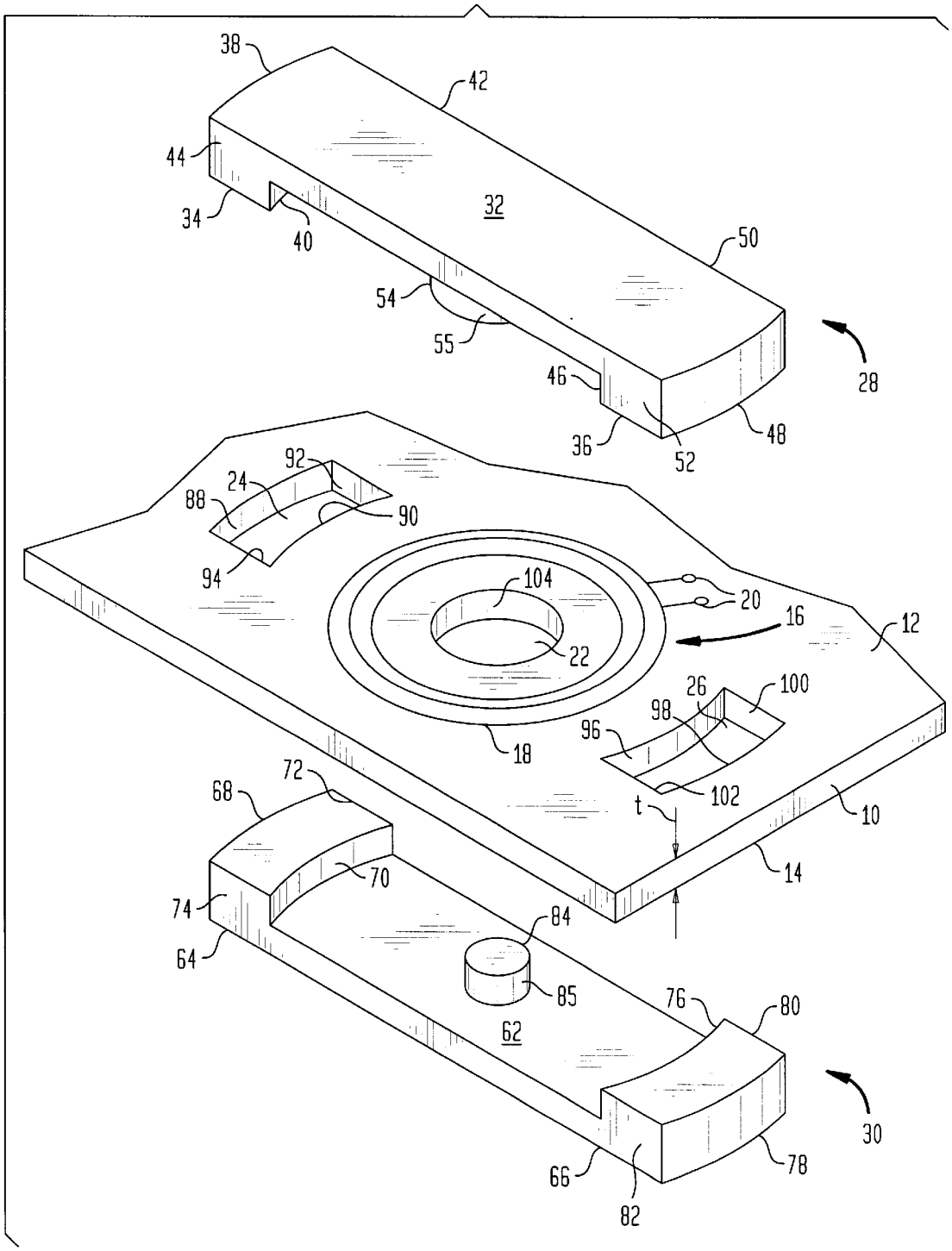
FIG. 1 is a perspective exploded view of a portion of an electrical device employing the apparatus of the present invention.

FIG. 1 is a perspective exploded view of a portion of an electrical device employing the apparatus of the present invention. In FIG. 1, a substrate 10 has an upper side 12 and a lower side 14. Substrate 10 has a thickness "t" intermediate upper side 12 and lower side 14. A planar magnetic element 16 is arrayed upon upper side 12. Planar magnetic element 16 includes an inductive circuit path 18 (shown schematically in FIG. 1) and connecting leads 20 for electrically connecting inductive circuit path 18 to other circuit elements (not shown in FIG. 1).

Substrate 10 has apertures 22, 24, 26 extending through substrate 10 intermediate upper side 12 and lower side 14. Aperture 22 is preferably a generally circular aperture situated substantially centrally within interactive circuit path 18.

A magnetic core assembly upper portion 28 and a magnetic core assembly lower portion 30 are illustrated in FIG. 1 in exploded relation with respect to substrate poised for assembly with substrate 10. Magnetic core assembly upper portion 28 is preferably formed of ferrous material to facilitate magnetic field generation by inductive circuit path 18. Magnetic core assembly upper portion 28 includes a base 32 and locating members 34, 36 extending from base 32. Locating members 34, 36 are preferably integrally formed with base 32, as by casting or molding, and extend a similar distance in the same direction from base 32. Most preferably, locating members 34, 36 are somewhat asymmetrical, as indicated by curved faces 38, 40 and linear faces 42, 44 bounding locating member 34, and as indicated by curved faces 46, 48 and linear faces 50, 52 bounding locating member 36.

A central member 54 also extends from base 32. Preferably core member 54 is integrally formed with base 32, as by casting or molding, and extends in the same direction from base 32 as locating members 34, 36. Core member 54 is preferably generally cylindrical presenting a generally cylindrical face 55 and configured to traverse aperture 22 during assembly of magnetic core assembly upper portion 28 with substrate 10.

Magnetic core assembly lower portion 30 is substantially similar in configuration to magnetic core assembly upper portion 28. Magnetic core assembly lower portion 30 is preferably formed of ferrous material to facilitate magnetic field generation by inductive circuit path 18. Magnetic core assembly lower portion 30 includes a base 62 and locating members 64, 66 extending from base 62. Locating members 64, 66 are preferably integrally formed with base 62, as by casting or molding, and extend a similar distance in the same direction from base 62. Most preferably, locating members 64, 66 are somewhat asymmetrical, as indicated by curved faces 68, 70 and linear faces 72, 74 bounding locating member 64, and as indicated by curved faces 76, 78 and linear faces 80, 82 bounding locating member 66.

A central member 84 also extends from base 62. Preferably core member 84 is integrally formed with base 62, as by casting or molding, and extends in the same direction from base 62 as locating members 64, 66. Core member 84 is preferably generally cylindrical presenting a generally cylindrical face 85 and configured to traverse aperture 22 during assembly of magnetic core assembly lower portion 30 with substrate 10.

Apertures 24, 26 in substrate 10 are preferably complimentarily formed to accept locating members 34, 36, 64, 66 during assembly of magnetic core assembly portions 28, 30 with substrate 10. Aperture 24 is bounded by curved faces 88, 90 and linear faces 92, 94. Aperture 26 is bounded by curved faces 96, 98 and linear faces 100, 102. Aperture 22 is bounded by a substantially circular face 104.

When magnetic core assembly upper portion 28, magnetic core assembly lower portion 30 and substrate 10 are assembled, locating members 34, 64 are in abutting arrangement within aperture 24; locating members 36, 66 are in abutting arrangement within aperture 26; and core members 54, 84 are in abutting arrangement within aperture 22. In this assembled orientation, several mating surface pairs are established: Cylindrical faces 55, 85 mate with circular face 104. Curved faces 40, 70 mate with curved face 90. Curved faces 38, 68 mate with curved face 88. Linear faces 42, 72 mate with linear face 92. Linear faces 34, 64 mate with linear face 94. Curved faces 46, 76 mate with curved face 96. Curved faces 48, 78 mate with curved face 98. Linear faces 50, 80 mate with linear face 100. Linear faces 52, 82 mate with linear face 102.

The structures illustrated in FIG. 1 are exemplary only. Other configurations may serve as well in employing the present invention. For example, magnetic core assembly upper portion 28 may comprise only base 32. That is magnetic core assembly upper portion 28 may be configured simply as a bar. In such an alternate arrangement, assembly of magnetic core assembly upper portion 28, magnetic core assembly lower portion 30 and substrate 10 results in locating members 64, 66 extending through apertures 24, 26, and core member 84 extending through aperture 22 in order that locating members 64, 66 and core member 84 may be in abutting relation with base 32 in assembled orientation with substrate 10. In whatever alternate assembly embodiment that may be selected, mating surfaces similar to the mating surfaces recited above will be established between substrate 10 and a magnetic core assembly portion, such as magnetic core assembly portions 28 or 30.

According to the present invention, magnetic core assembly portions 28, 30 are configured to do "double duty" as (1) establishing a magnetic flux circuit to enhance magnetic performance of inductive circuit path 18, and (2) participating in establishing a thermal path for conducting heat away from inductive circuit path 18 and from substrate 10. Such "double duty" advantage is accomplished by applying thermally conductive material to selected surfaces of substrate 10 and magnetic core assembly portions 28, 30. Representative selected surfaces are indicated in FIG. 1 by cross-hatching; mating surfaces to the cross-hatched surfaces may also receive thermally conductive material to further enhance heat dissipation. A preferred material for enhancing thermal conductivity in practicing the teachings of the present invention is copper. It is preferred that copper be plated in areas selected for enhanced thermal conductivity. Thus, for example, thermal conduction enhancing material (e.g., copper plating) may be applied to curved surfaces 40, 70 and may also be applied to curved surface 90. By way of further example, thermal conduction enhancing material (e.g., copper plating) may be applied to curved surfaces 48, 78 and may also be applied to curved surface 98. By way of further example, thermal conduction enhancing material (e.g., copper plating) may be applied to cylindrical surfaces 55, 85 and may also be applied to circular surface 104.

A significant consideration is applying thermally conductive material to surfaces is to avoid establishing a closed loop of thermally conductive material. If a closed loop is established—either a closed loop of thermally conductive material in a single component (i.e., magnetic core assembly upper portion 28, or magnetic core assembly lower portion 30 or substrate 10), or by a combined cooperative loop established by paired mating surfaces—there may thereby be established an inductive loop. Such extra inductive loops are best avoided.

In order that there will be good thermal conductivity among components—magnetic core assembly upper portion 28, or magnetic core assembly lower portion 30 and substrate 10—apertures and component portions passing through apertures are preferably configured to result in close mating relations with surfaces treated with thermally conductive material in an assembled orientation. Such close fitting mating arrangements are important for realizing significant thermal advantage by using the invention, but they also impose a limitation on employment of invention. By establishing such close mating relationships, thermal or electrical properties established by the addition of thermally conductive material may have electrical consequences that are the result of combined facing relations between mating surfaces. As a result of such combined effects by mating surfaces, care must be taken that a combined surface relation at a mating surface pair do not together establish a closed loop of thermally conductive material. Accordingly, mating surfaces will preferably have substantially coextensive areas of added thermally conductive material. Discontinuities in thermally conductive materials may be several in a given mating surface pairing. That is, the pattern for applying thermally conductive material upon two mating surfaces may appear, in aggregate, as a dashed line pattern. Preferably, in order to have maximum surface area available for thermal conduction, the pattern for applying thermally conductive material upon two mating surfaces may appear as a "C" shaped pattern (FIG. 2).

The thermal path enhanced by adding thermally conductive material leads heat away from interior portions of circuitry borne upon or otherwise associated with substrate 10 to magnetic core assembly portions 28, 30. One or both of magnetic core assembly portions 28, 30 may be in a thermally conductive relation with a heat sink (not shown in FIG. 1) to aid in conducting heat to ambient surroundings about a product including substrate 10.

Figure 2:
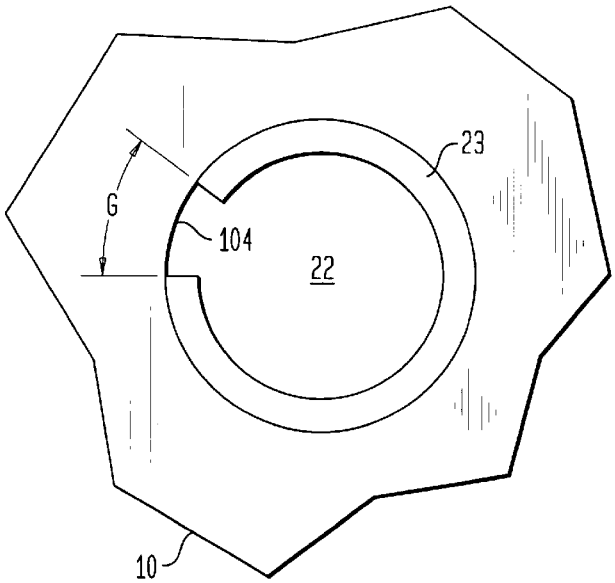
FIG. 2 is a plan view of an exemplary aperture employing the present invention.

FIG. 2 is a plan view of an exemplary aperture employing the present invention. In FIG. 2, a fragment of substrate 10 is illustrated containing aperture 22. Aperture 22 has thermally conductive material 23 applied to circular face 104 in a pattern that does not completely circumscribe aperture 22. A gap "G" is left in the pattern of thermally conductive material 23 upon circular face 104 in order to avoid establishing an inductive loop. Similar arrangements are preferably provided in applying thermally conductive material to other surfaces by selectively applying thermally conductive material, for example, only to selected exterior walls of locating members 34, 36, 64, 66; or only to selected interior walls of apertures 24, 26; or to only a portion of circumferences of cylindrical faces 55, 85. It is important to keep in mind that in structures employing the present invention in which thermally conductive material is applied to both facing surfaces in a mating relationship, the patterns for applying thermal conductive material must, in aggregate, avoid establishing a closed loop.

Figure 3:
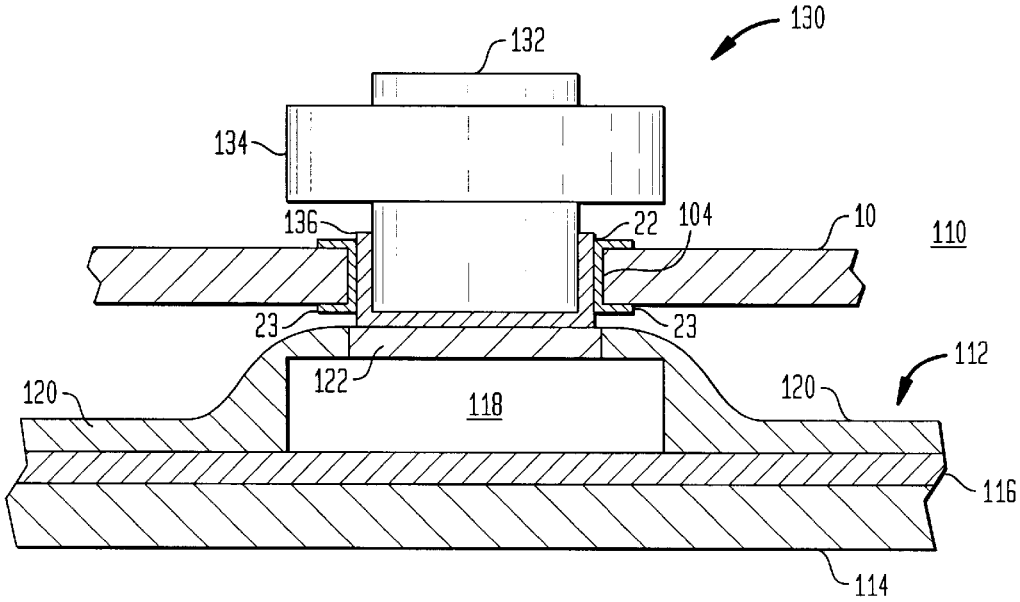
FIG. 3 is a partial section elevation view of a discrete electrical device in a substantially assembled orientation configured according to the teachings of the present invention.

FIG. 3 is a partial section elevation view of a discrete electrical device in a substantially assembled orientation configured according to the teachings of the present invention. In FIG. 3, an electrical assembly 110 includes a substrate 112. Substrate 112 is an insulated metal substrate having a metallic layer 114 and a dielectric layer 116. Preferably, metallic layer 114 is an aluminum layer, and dielectric layer 116 is a layer of dielectric material that has good thermal conducting qualities, such as Kapton. A copper pad 118 is deposited on substrate 112 and partially overlaid by a dielectric deposition layer 120. A solder pad 122 is situated upon copper pad 118. A magnetic assembly 130 is incorporated into device 110. Magnetic assembly 130 includes a ferrous core 132 surrounded by a winding 134. Magnetic assembly 130 is situated in a substrate 10 having an aperture 22 with a circular face 104. A layer of thermally conductive material 23 is applied upon circular face 104 of aperture 22. Layer 23 may be applied, for example, as a coating, or as a cladding or by another application technique in the embodiment of the present invention illustrated in FIG. 3.

A layer of thermally conductive material 136 is applied to ferrous core 132 appropriately to provide a substantially mating fit among ferrous core 132, layer 136, layer 23 and circular face 104 when magnetic assembly 130 is in its assembled orientation traversing substrate 10. In the assembled orientation illustrated in FIG. 3, layer 136 is preferably bonded with copper pad 118 by solder pad 122.

In the exemplary electrical assembly 130 illustrated in FIG. 3, a thermal path is established from substrate 10 and from magnetic assembly 130 through ferrous core 132, through layers 23, 136 of thermally conductive material, through solder pad 122, through copper pad 118, through dielectric layer 116 (dielectric layer 116 preferably has good electrical insulation properties without impeding heat transfer) and to metallic layer 114. Metallic layer 114 has significant surface area to dissipate heat. If additional heat dissipation is required, heat sink apparatuses may be employed with electrical assembly 110 in manners known to those skilled in the art of power circuit design.

Figure 4:
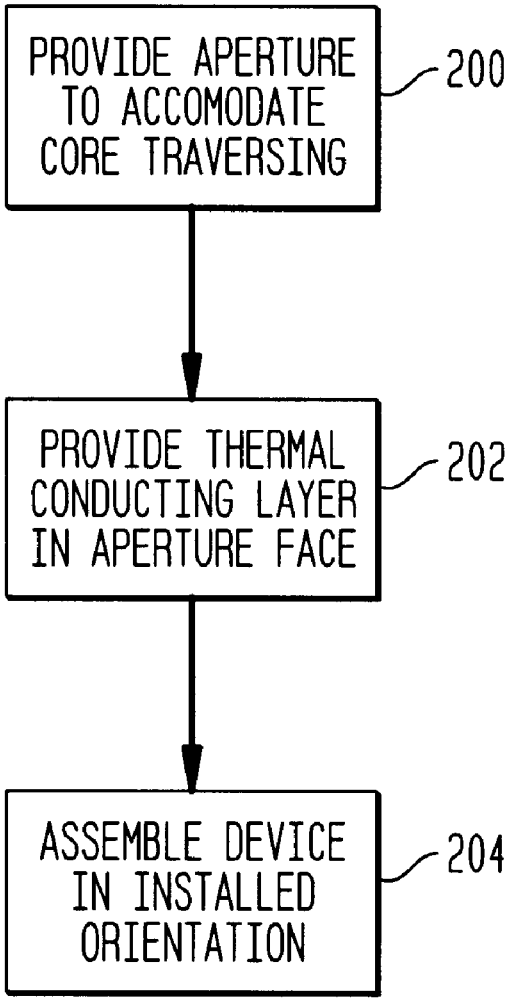
FIG. 4 is a block diagram illustrating the method of the present invention.

FIG. 4 is a block diagram illustrating the method of the present invention. In FIG. 4, a method for facilitating heat dissipation in an electrical device including a core structure traversing a substrate when the core structure is in an installed orientation begins with the step of providing at least one aperture through the substrate for accommodating the traversing by the core structure, as indicated by a block 200. Each respective aperture has a periphery defined by a respective circumjacent face extending a height substantially equal with the thickness of the substrate.

The method continues with providing a layer of thermally conductive material situated in a discontinuous arrangement on the circumjacent face of at least one respective aperture, as indicated by a block 202.

The method continues with assembling the electrical device in the installed orientation, as indicated by a block 204. The at least one respective aperture is configured to establish a thermally conductive engagement with at least one facing portion of the core structure traversing the at least one respective aperture in the installed orientation.

It is to be understood that, while the detailed drawings and specific examples given describe preferred embodiments of the invention, they are for the purpose of illustration only, that the apparatus and method of the invention are not limited to the precise details and conditions disclosed and that various changes may be made therein without departing from the spirit of the invention which is defined by the following claims.

We claim:

1. An apparatus for facilitating heat dissipation in an electrical device including a core structure traversing a substrate when said core structure is in an installed orientation; said substrate having a thickness; the apparatus comprising:

(a) at least one aperture through said substrate for accommodating said traversing by said core structure; each respective aperture of said at least one aperture having a periphery defined by a respective circumjacent face, said circumjacent face extending a height substantially equal with said thickness;

(b) a layer of thermally conductive material situated in a discontinuous arrangement on said circumjacent face of at least one said respective aperture;

said at least one respective aperture being configured to establish a thermally conductive engagement with at least one facing portion of said core structure traversing said at least one respective aperture in said installed orientation.

2. An apparatus for facilitating heat dissipation in an electrical device including a core structure traversing a substrate when said core structure is in an installed orientation as recited in claim 1 wherein said discontinuous arrangement presents one discontinuity in said thermally conductive material.

3. An apparatus for facilitating heat dissipation in an electrical device including a core structure traversing a substrate when said core structure is in an installed orientation as recited in claim 2 wherein a layer of a thermally conductive material is situated in a discontinuous arrangement on at least one respective facing portion of said at least one facing portion of said core structure.

4. An apparatus for facilitating heat dissipation in an electrical device including a core structure traversing a substrate when said core structure is in an installed orientation as recited in claim 1 wherein a layer of a thermally conductive material is situated in a discontinuous arrangement on at least one respective facing portion of said at least one facing portion of said core structure.

5. An apparatus for facilitating heat dissipation in an electrical device including a core structure traversing a substrate when said core structure is in an installed orientation as recited in claim 1 wherein said discontinuous arrangement presents a plurality of discontinuities in said thermally conductive material.

6. An apparatus for facilitating heat dissipation in an electrical device including a core structure traversing a substrate when said core structure is in an installed orientation as recited in claim 3 wherein a layer of a thermally conductive material is situated in a discontinuous arrangement on at least one respective facing portion of said at least one facing portion of said core structure.

7. An apparatus for facilitating heat dissipation in an electrical device including a core structure traversing a substrate when said core structure is in an installed orientation; said substrate having a thickness; said core structure including a core and a plurality of integrally formed support members; the apparatus comprising:

(a) a first aperture through said substrate for accommodating said traversing by said core; said first aperture having a first periphery defined by a first circumjacent face, said first circumjacent face extending a height substantially equal with said thickness;

(b) a plurality of second apertures through said substrate for accommodating said traversing by said plurality of support members; each respective second aperture of said plurality of second apertures having a second periphery defined by a second circumjacent face, said second circumjacent face extending a height substantially equal with said thickness;

(c) a layer of thermally conductive material situated in a discontinuous arrangement on said first circumjacent face;

said first aperture being configured to establish a thermally conductive engagement with at least one facing portion of said core in said installed orientation.

8. An apparatus for facilitating heat dissipation in an electrical device including a core structure traversing a substrate when said core structure is in an installed orientation as recited in claim 7 wherein a layer of thermally conductive material is situated in a discontinuous arrangement on said second circumjacent face of at least one second aperture of said a plurality of second apertures; said at least one second aperture being configured to establish a thermally conductive engagement with at least one facing portion of a respective support member of said plurality of support members in said installed orientation.

9. An apparatus for facilitating heat dissipation in an electrical device including a core structure traversing a substrate when said core structure is in an installed orientation as recited in claim 8 wherein said discontinuous arrangement presents one discontinuity in said thermally conductive material.

10. An apparatus for facilitating heat dissipation in an electrical device including a core structure traversing a substrate when said core structure is in an installed orientation as recited in claim 8 wherein a layer of a thermally conductive material is situated in a discontinuous arrangement on at least one respective facing portion of said at least one facing portion of said core and with at least one facing portion of said respective support member.

11. An apparatus for facilitating heat dissipation in an electrical device including a core structure traversing a substrate when said core structure is in an installed orientation as recited in claim 7 wherein said discontinuous arrangement presents one discontinuity in said thermally conductive material.

12. An apparatus for facilitating heat dissipation in an electrical device including a core structure traversing a substrate when said core structure is in an installed orientation as recited in claim 8 wherein said discontinuous arrangement presents a plurality of discontinuities in said thermally conductive material.

13. An apparatus for facilitating heat dissipation in an electrical device including a core structure traversing a substrate when said core structure is in an installed orientation as recited in claim 7 wherein a layer of a thermally conductive material is situated in a discontinuous arrangement on at least one respective facing portion of said at least one facing portion of said core.

14. An apparatus for facilitating heat dissipation in an electrical device including a core structure traversing a substrate when said core structure is in an installed orientation as recited in claim 7 wherein said discontinuous arrangement presents a plurality of discontinuities in said thermally conductive material.

15. A method for facilitating heat dissipation in an electrical device including a core structure traversing a substrate when said core structure is in an installed orientation; said substrate having a thickness; the method comprising the steps of:

(a) providing at least one aperture through said substrate for accommodating said traversing by said core structure; each respective aperture of said at least one aperture having a periphery defined by a respective circumjacent face, said circumjacent face extending a height substantially equal with said thickness;

(b) providing a layer of thermally conductive material situated in a discontinuous arrangement on said circumjacent face of at least one said respective aperture; and (c) assembling said electrical device in said installed orientation;

said at least one respective aperture being configured to establish a thermally conductive engagement with at least one facing portion of said core structure traversing said at least one respective aperture in said installed orientation.

16. A method for facilitating heat dissipation in an electrical device including a core structure traversing a substrate when said core structure is in an installed orientation as recited in claim 15 wherein said discontinuous arrangement presents one discontinuity in said thermally conductive material.

17. A method for facilitating heat dissipation in an electrical device including a core structure traversing a substrate when said core structure is in an installed orientation as recited in claim 16 wherein a layer of a thermally conductive material is situated in a discontinuous arrangement on at least one respective facing portion of said at least one facing portion of said core structure.

18. A method for facilitating heat dissipation in an electrical device including a core structure traversing a substrate when said core structure is in an installed orientation as recited in claim 15 wherein a layer of a thermally conductive material is situated in a discontinuous arrangement on at least one respective facing portion of said at least one facing portion of said core structure.

19. A method for facilitating heat dissipation in an electrical device including a core structure traversing a substrate when said core structure is in an installed orientation as recited in claim 15 wherein said discontinuous arrangement presents a plurality of discontinuities in said thermally conductive material.

20. A method for facilitating heat dissipation in an electrical device including a core structure traversing a substrate when said core structure is in an installed orientation as recited in claim 19 wherein a layer of a thermally conductive material is situated in a discontinuous arrangement on at least one respective facing portion of said at least one facing portion of said core structure.

* * * * *